US005165130A

United States Patent [19]

Wendling

[11] Patent Number: 5,165,130

[45] Date of Patent: Nov. 24, 1992

[54] MULTIPOSITIONAL INFANT SUPPORT SYSTEM

[76] Inventor: Helen L. Wendling, 98 West Floyd Ave., Dayton, Ohio 45415

[21] Appl. No.: 824,993

[22] Filed: Jan. 24, 1992

[51] Int. Cl.[5] ..... A47D 7/00; A47G 9/00

[52] U.S. Cl. ..... 5/655; 5/424; 5/657; 5/922

[58] Field of Search ..... 5/655, 657, 420, 424, 5/425, 640, 922, 630, 632

[56] References Cited

U.S. PATENT DOCUMENTS

| | | | |
|---|---|---|---|
| 2,629,884 | 3/1953 | McMonagle | 5/455 |
| 2,765,480 | 10/1956 | Mueller | 5/640 |
| 2,952,856 | 9/1960 | Ruff | 5/640 |
| 4,274,673 | 6/1981 | Kifferstein | 5/640 |
| 4,607,402 | 8/1986 | Pollard | 5/425 |

*Primary Examiner*—Alexander Grosz
*Attorney, Agent, or Firm*—Frost & Jacobs

[57] ABSTRACT

A multipositional infant support system includes a flexible panel that permits a pair of cushions to be arranged in various positions to support and secure an infant in a variety of positions.

16 Claims, 7 Drawing Sheets

MULTIPOSITIONAL INFANT SUPPORT SYSTEM

TECHNICAL FIELD

The present invention relates generally to infant support systems and will be specifically disclosed in connection with a multipositional support system for supporting an infant in a variety and lying and sitting positions.

BACKGROUND OF THE INVENTION

It is well known that many infants have a tendency to roll over when placed in a lying position, and that safety and other concerns dictate the necessity of confining the area in which the infant can roll. In order to accommodate the infant, and to limit the area in which the infant can roll, it is well known to provide mats or pads with enlarged areas with ridges of resilient foam material on their peripheries. Examples of such mats or pads are illustrated in U.S. Pat. No. 4,712,258 to Eves, and U.S. Pat. No. 3,761,975 to Personett.

While mats and pads of the type described above have generally proved to be successful, they have suffered from their lack of flexibility. Specifically, the utility of these types of mats and pads have generally been limited to infants that have been sleeping, and are in a lying position. These types of mats and pads are not generally designed to accommodate other positions of an infant that has not developed sufficient strength to support his/her body in a sitting or crawling position.

Moreover, many of the mats and pads of the type described above are large and awkward to transport or store. For this reason, portable, collapsible baby beds have been developed, such as that illustrated in U.S. Pat. No. 4,999,863 to Kane. However, these portable baby beds have also generally been limited to single types of usages, specifically, used for an infant in a lying position.

SUMMARY OF THE INVENTION

Accordingly, it is a primary object of the present invention to provide an infant support system that has sufficient flexibility to accommodate an infant in a variety of positions.

It is another object of the invention to provide a readily portable, lightweight infant support system that can both confine an infant in a lying position and support the infant in other positions.

It is yet another object to provide a flexible, portable, lightweight infant support system that supports an infant in a variety of positions, and secures the infant against falling from those positions.

Additional objects, advantages, and novel features of the invention will be set forth in part in the description which follows, and a part will become apparent to those skilled in the art upon examination of the following or may be learned by practice of the invention. The objects and advantages of the invention may be realized and obtained by means of the instrumentalities and combinations particularly pointed out in the appended claims.

To achieve the foregoing and other objects and in accordance with the purposes of the present invention, as embodied and broadly described herein, a multipositional infant support system is provided for supporting an infant in a variety of positions. The system includes a substantially rectangular panel of sheet material that is sufficiently flexible so as to be freely foldable along a plurality of arbitrary fold lines. Longitudinal cushions of resilient material are releasably secured to each of the two opposite sides of the panel. The cushions are in spaced parallel relationship so as to provide a centrally disposed confinement area on the panel for confining an infant between the cushions whenever the confinement area of the panel is in a flattened, nonfolded condition, but are moveable to different relative positions when the panel is folded or flexed. Means also are provided for releasably interlocking and joining the cushions at their respective ends so as to provide an infant back support at the joined ends of the cushions when the panel is folded and the cushions are placed in a V-shape configuration.

In accordance with another aspect of the invention, the first and second longitudinal cushions are retained by first and second enclosures formed by overlapping opposite sides of the panel inwardly toward the confinement area.

In yet another aspect of the invention, a plurality of hook and loop fasteners are provided for releasably securing the opposite sides of the panel in their respective inwardly overlapped positions.

In accordance with a more specific aspect of the invention, the hook and loop fasteners include a first strip component on the edge of the panel side and a second cooperating strip component positioned inwardly on the panel at the edge of the confinement area. The second strip component is preferably in spaced parallel relationship to the first strip component.

According to yet another aspect of the invention, a plurality of straps are secured to the panel for releasably securing an infant in a variety of positions relative to the longitudinal cushions.

In yet another aspect of the invention, the panel is foldable so as to position the longitudinal cushion enclosures in a contacting longitudinally juxtaposed relationship.

In another specific aspect of the invention, a strap is secured to the central portion of the confinement area. The strap preferably extends beneath the confinement area in a direction parallel to the longitudinal direction of the cushions.

In yet another aspect of the invention, a pair of cooperating straps are secured to the longitudinal cushion enclosures for securing an infant in a sitting position adjacent the joined ends of the cushions when the cushions are in a V-shaped configuration.

In a still further aspect of the invention, the cushions have a generally square cross-sectional configuration, and each of the cushion enclosures are formed by four sections of substantially equal area separated by substantially parallel fold lines.

In still another aspect of the invention, the hook and loop fasteners are secured to the third most outer section of each side for releasably securing the cushion members in the contacting longitudinally juxtaposed relationship.

In still another aspect of the invention, end covers are joined to each longitudinal end of the second most outer section from each side. The end covers are joined to this section by a fold line that is substantially perpendicular to the fold line separating the four sections.

In still another aspect of the invention, a resilient pad is removably positioned in the confinement area between the longitudinal cushions.

The description which follows sets forth a preferred embodiment of this invention, simply by way of illustration of one of the best modes contemplated by carrying out the invention. It will be apparent that the invention is capable of other different embodiments, and its several details are capable of modification in various, obvious aspects all without departing from the spirit of the invention. Accordingly, the drawings and descriptions will be regarded as illustrative in nature and not as restrictive.

BRIEF DESCRIPTION OF THE DRAWINGS

The accompanying drawings, which are incorporated in and form a part of the specification, illustrate a preferred embodiment of the present invention, and, together with the description, serve to explain the principles of the invention. In the drawings.

Reference will now be made in detail to the present preferred embodiment of the invention, an example of which is illustrated in the accompanying drawings.

DETAILED DESCRIPTION OF THE PREFERRED EMBODIMENT

Figure 1:
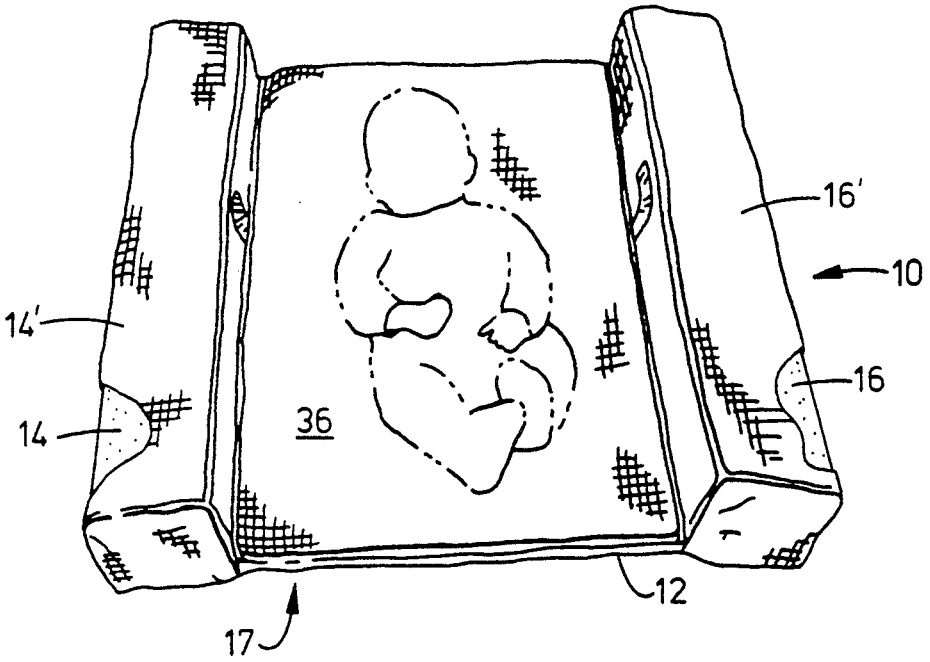
FIG. 1 is a perspective view of an infant support assembly constructed in accordance with the present invention illustrating an infant shown in a lying in confined area between two longitudinal cushions of resilient foam material.

Referring now to the drawings, FIG. 1 depicts an infant (shown in phantom lines) lying on a support system 10 constructed in accordance with the Principles of the present invention. The support system 10 includes a substantially rectangular panel 12 of sheet material, which panel is most clearly depicted in FIG. 2. The sheet material is sufficiently flexible so as to allow the panel 12 to be freely foldable along a plurality of arbitrarily chosen fold lines. The sheet material is preferably a soft fabric such as terry cloth. The panel 12 is shown in FIG. 1 as extending between first and second enclosed longitudinal cushions 14 and 16. These cushions 14 and 16 are secured by respective enclosures 14' and 16' to oppositely disposed peripheral side edges of the panel 12. The cushions 14 and 16 are formed in the illustrated embodiment of resilient foam material. Each of the longitudinal cushions 14 and 16 preferably has a longitudinal length that is matched to the length of the panel 12, which in the preferred embodiment is approximately 31 inches. The cushions 14 and 16 are preferably square in cross-sectional configuration. In the preferred embodiment, the cushions 14 and 16 are formed of square foam lengths having 4 inch sides.

Figure 2:
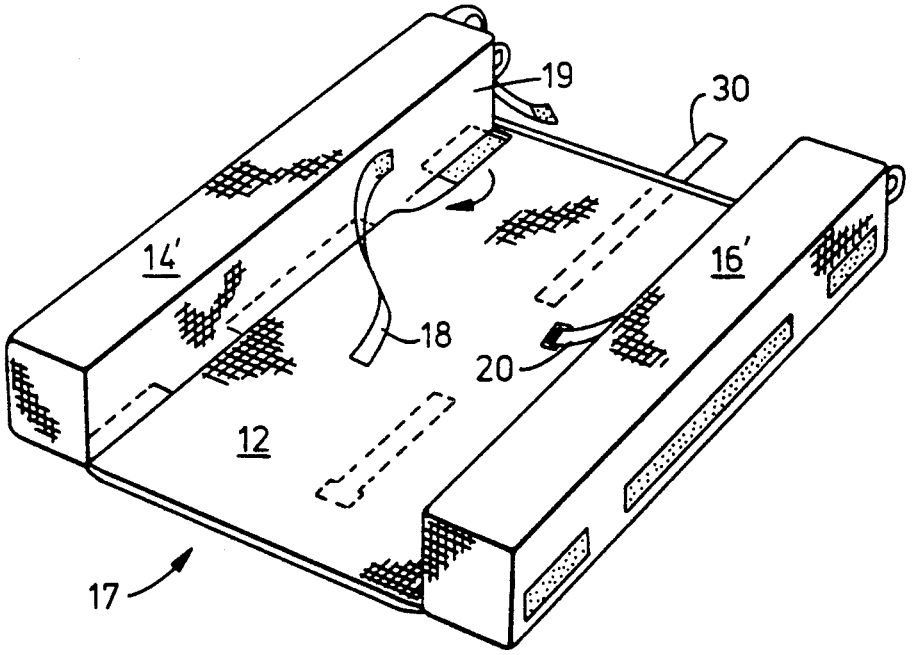
FIG. 2 is a perspective view of the infant support assembly of FIG. 1 without the infant illustrating a series of belts used to support an infant in various positions.

As illustrated in FIGS. 1 and 2, the cushions 14 and 16 are in spaced parallel relationship, separated by a distance of approximately 18½ inches. In this position, the cushions 14 and 16 define the boundaries of an infant confinement area 17 on the panel 12, and the cushions 14, 16 function to prevent the infant from rolling off of the confinement area 17.

Figure 3:
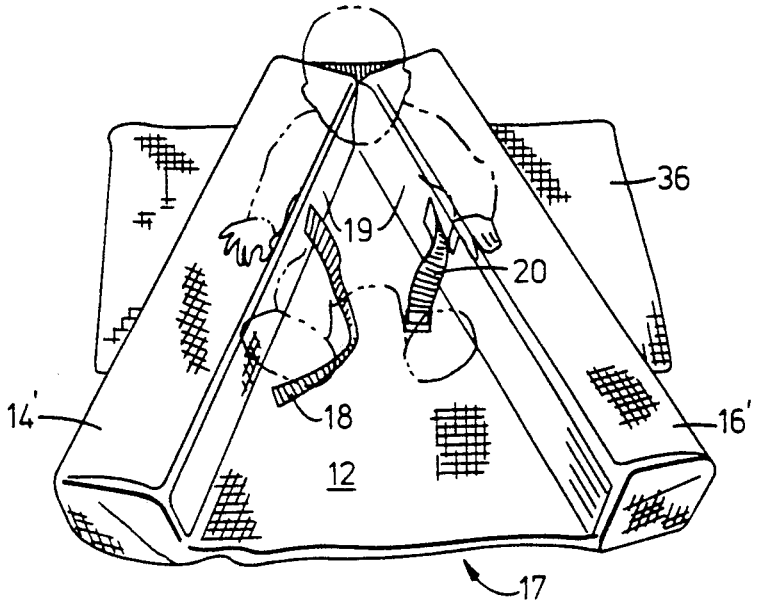
FIG. 3 is a perspective view of the infant support assembly of FIGS. 1 and 2, but illustrating the longitudinal cushion members reoriented to a V-shaped configuration for supporting an infant in a sitting position.
Figure 4:
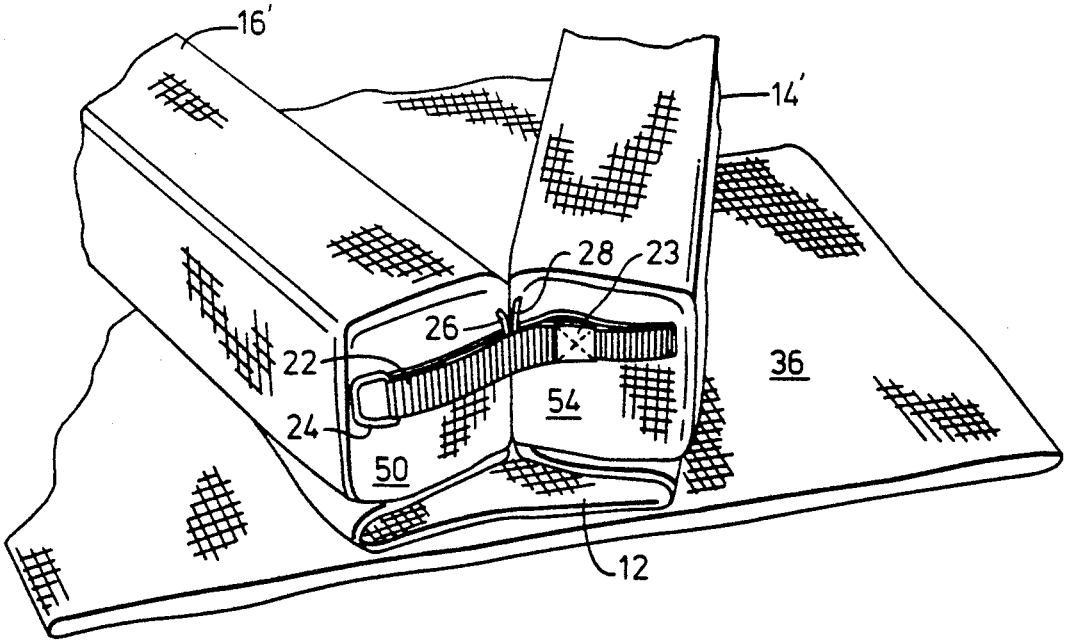
FIG. 4 is an enlarged fragmentary view of the two adjoining end sections of the V-shaped configured longitudinal cushion members of FIG. 3 showing how the cushions are interlocked.

Turning now to FIGS. 3 and 4, it can be seen that the cushions, 14 and 16, and their respective enclosures 14' and 16', can readily be moved relative to each other. As illustrated in FIG. 3, the cushions 14 and 16 are oriented in a V-shaped configuration with one respective end of each of the cushions 14 and 16 being joined, with the opposite ends of these same cushions diverging outwardly and being being spaced at their outermost ends by approximately 18 inches. When the cushions 14, 16 are joined and interlocked in this V-shaped configuration, a back support 19 for an infant is formed near the apex of the converging cushions 14, 16 FIG. 3 shows (in phantom) an infant supported in a sitting position by the converging cushions 14, 16. Straps 18 and 20 extend outwardly from the fabric enclosures 14' and 16' for these cushions 14 and 16, respectively, to secure the infant and to prevent the infant from falling forward into the open Position between the cushions in the area opposite the apex. Strap 20 preferably has a buckle on its outward end portion for selectively interlocking with the strap 18. As perhaps most clearly illustrated in FIG. 4, relative movement between the cushions 14 and 16 is facilitated by the flexibility of the panel 12, which panel 12 is shown in FIG. 4 in overlying folded orientation. FIG. 4 also depicts the manner in which the cushions 14, 16 of the preferred embodiment are releasably joined and interlocked. A strap 22 is secured on the end portion for the enclosure 14' and this strap 22 interlocks through a pair of fabric cord loops 24 and 26 secured to the end portion for the enclosure 16' for cushion 16. The strap 22 preferably includes hook and loop fasteners 23 (see FIG. 12) on its end portions so that the end portions of the strap 22 can be releasably secured to each other. An end portion for the enclosure 16' also has a fabric cord loop 28 for securing the strap 22. When the cushions 14 and 16 are joined together, the strap 22 is run through the fabric cord loops 24, 26 and 28, and is tightened and secured, as shown in FIG. 4.

Figure 5:
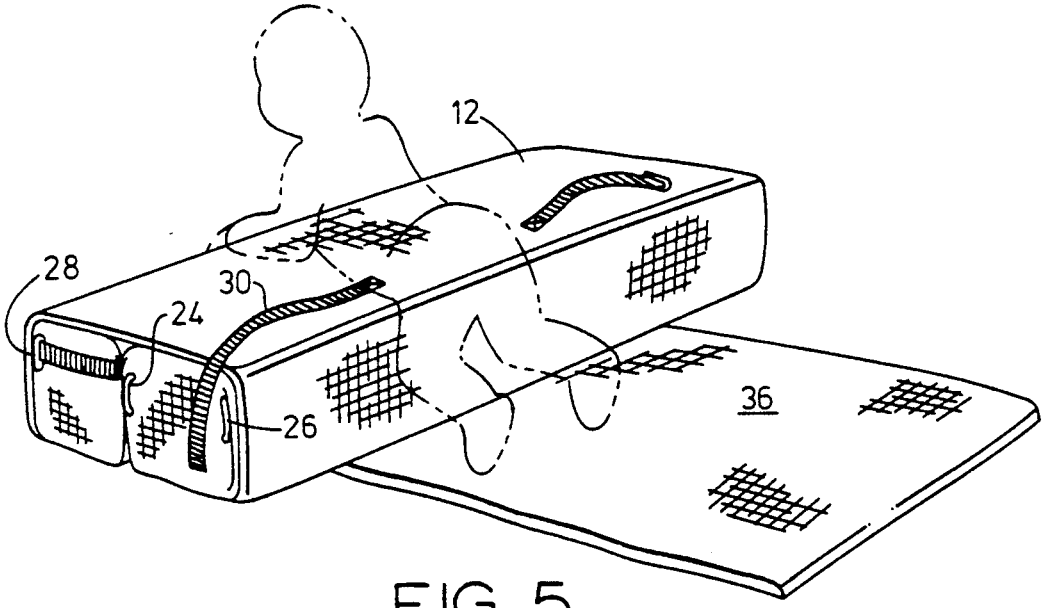
FIG. 5 is a perspective view showing the two longitudinal cushions of FIG. 1 in juxtaposed relationship to provide a common chest and abdominal support for an infant.
Figure 6:
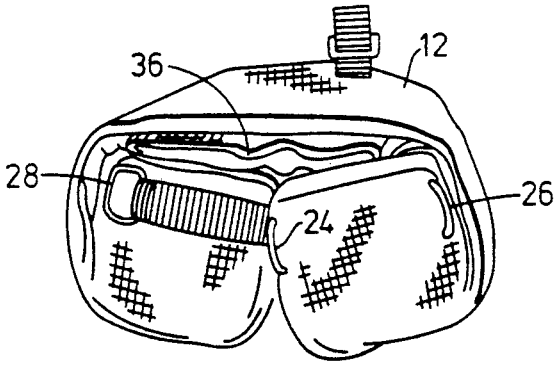
FIG. 6 is an end view of the infant support assembly of FIG. 5.

The flexibility of the panel 12 also permits the cushions 14 and 16 to be placed in a longitudinally juxtaposed contacting parallel relationship as shown in FIGS. 5 and 6. In this position, the cushions 14 and 16 cooperate to functionally form a single resilient support surface on their top sides. The Panel 12 is wrapped around the cushions 14 and 16 in this position to provide a continuous surface supporting the chest and abdominal areas of the infant in the manner illustrated in FIG. 5. A strap 30 secured to the panel 12 can be used to secure the infant in this illustrated position.

Figure 7:
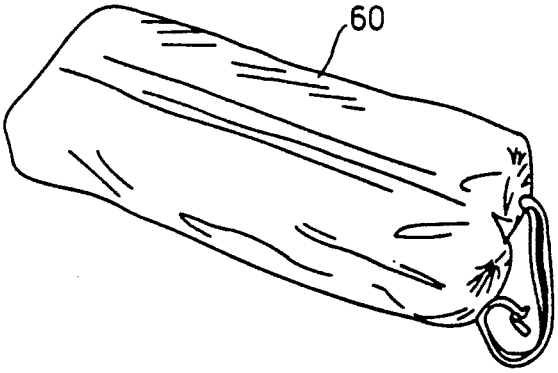
FIG. 7 is a perspective view of a drawstring carrying bag for transporting the infant support assembly of FIG. 6.
Figure 11:
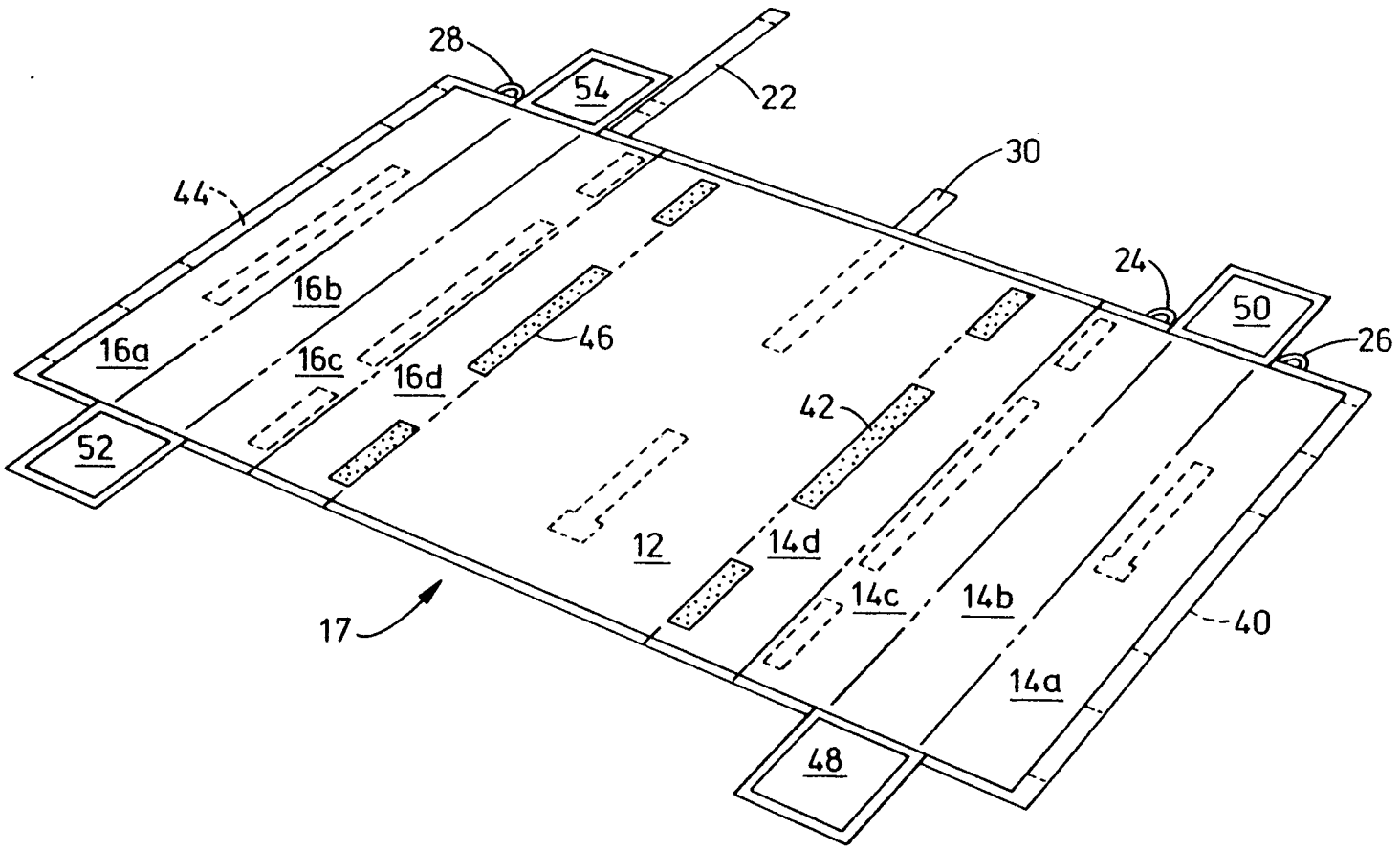
FIG. 11 is a perspective view of a fabric showing the top of a fabric that is used to form the panel underlying the confined area and fabric securing structure for enclosing the longitudinal cushion members in the infant support system of FIG. 1.
Figure 12:
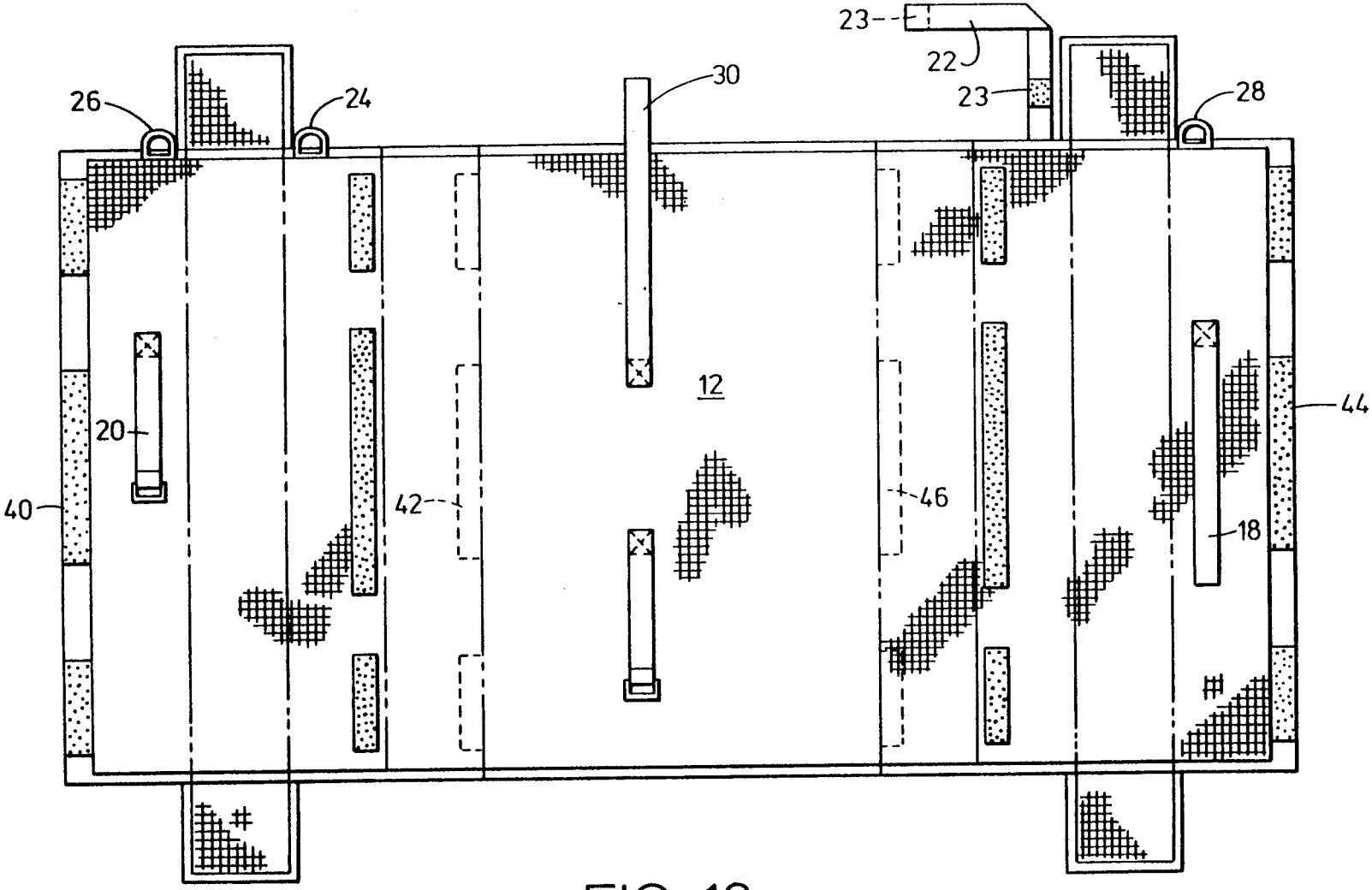
FIG. 12 is a bottom view of the fabric panel of FIG. 11.

As can be seen from FIG. 2, 11 and 12, the cushion enclosures 14' and 16' each contain strips 19 of hook and loop fasteners. When the cushions 14, 16 are positioned in the arrangement of FIGS. 5 and 6, the strips 19 are pressed in contacting relationship, and the strips function to hold the cushions 14, 16 together. When in this position, the system can also be inserted into drawstring-bag 21, shown in FIG. 7, for easy transport and storage.

Figure 8:
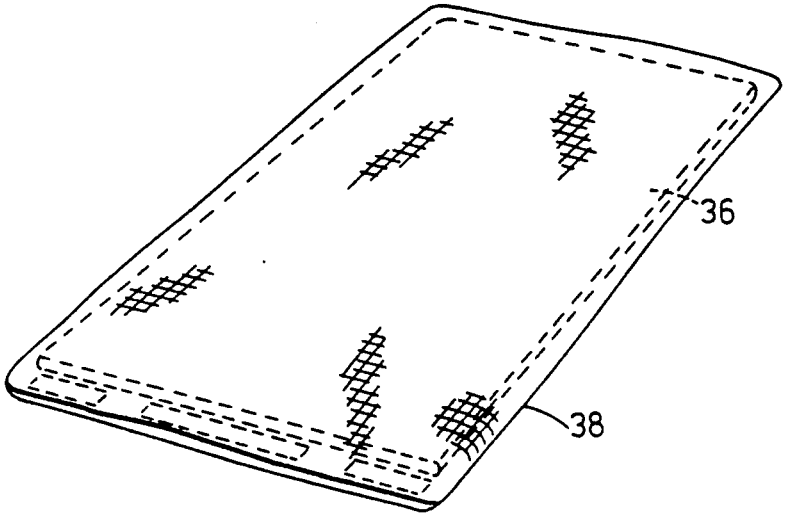
FIG. 8 is a perspective view of a fabric covered cushion used in the infant support assembly of FIG. 1.
Figure 9:
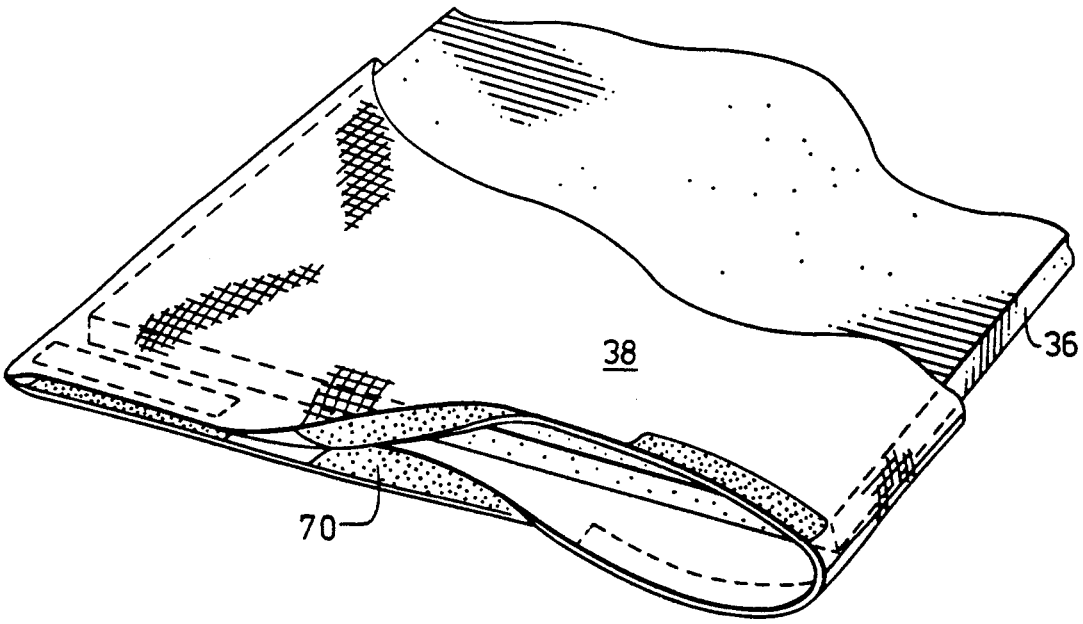
FIG. 9 is an enlarged fragmentary view showing an end portion of the cushion of FIG. 8 with the fabric cover partially opened.

A mattress pad 36 is optionally added to the support system to enhance the infants comfort. This mattress pad 36, which is shown most clearly in FIGS. 8 and 9, has a size roughly equivalent to the size of the confinement area 17, and consists in the Preferred embodiment of a ½ in. resilient rectangular foam mattress pad having a size of approximately 18"×30". This pad 36 is preferably covered or encased with a fabric 38, such as terry cloth. In order to facilitate the washing of the mattress pad, the fabric encasement is releasably closeable about one end, as shown in FIG. 9, to permit separation of the pad 36 and fabric 38. This may be achieved through the use of hook and loop fasteners 40 attached to the internal edges of the encasement, and as shown in FIG. 9.

Figure 10:
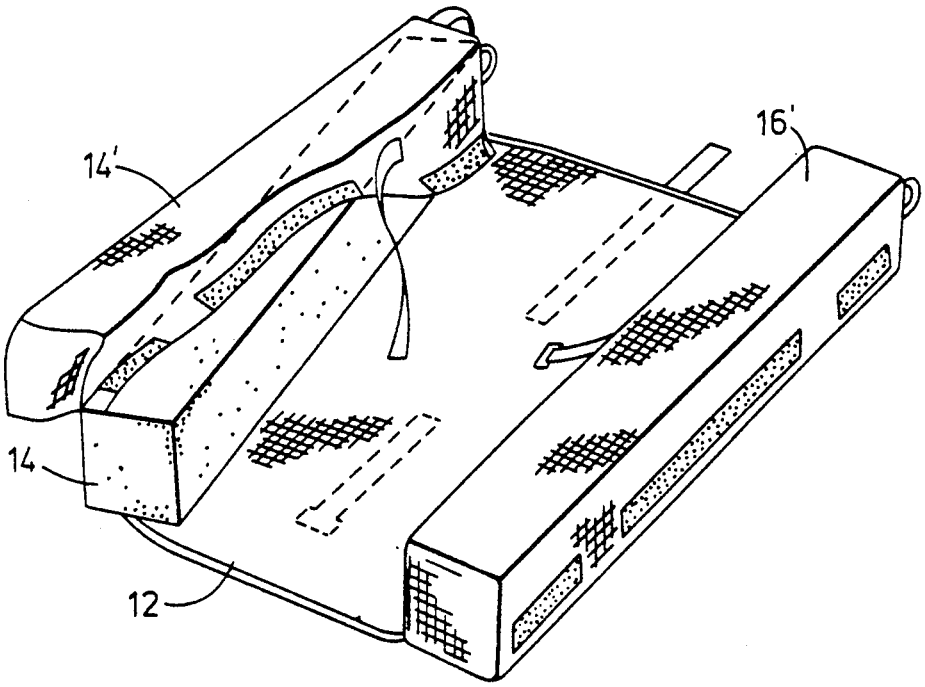
FIG. 10 is a perspective view of the infant supPort assembly of FIG. 1 showing one of the longitudinal cushions partially removed from its fabric securing structure.

Turning now to FIG. 10, it can be seen that the cushions 14, 16 are secured to the panel 12 by fabric enclosures 14', 16' that are affixed to the Peripheral sides of the panel 12. In the preferred embodiment, these enclosures 14', 16' are integral with the panel 12, and are formed by overlapping the opposite sides of the panel 12 inwardly toward the confinement area 19. The enclosures 14', 16' releasably secure their respective cushions 14, 16 through the agency of hook and loop fasteners, as will be more fully described below.

Turning now to FIGS. 11 and 12, the respective top and bottom portions of the unfolded panel 12 are illustrated. It can be seen that each of the enclosures 14' and 16' are formed of four substantially equally sized sections of the panel 12. Enclosure 14' is formed of sections **14*a*, 14*b*, 14*c* and 14*d*. Similarly, enclosure 16' is formed of section 16*a*, 16*b*, 16*c*, and 16*d*. Each of these sections are separated by fold lines that are substantially parallel to the edges of the panel 12**.

As noted above, the enclosures 14', 16' are releasably closed by hook and loop fasteners. One component of each such fastener is secured to a strip on the side edge of the panel 12, as, for example, the outermost section **14*a*, as shown by strip 40 illustrated in FIG. 12. This strip 40 is connectable to strip 42 secured to the inside edge of section 14*d*, adjacent the confinement area 17. In order to enable the strips 40 and 42 to interface when the enclosure 14' is overlapped, strip 40 is on the bottom side of panel 12, while panel 42 is on the top side. Strips 44 and 46 of enclosure 16'** operate in a similar fashion.

It will also be observed from FIGS. 11 and 12 that sections **14*b* and 16*b* of the respective enclosures 14' and 16' each have covers joined to the respective longitudinal ends, end covers 40*a* and 50 being joined to section 14*d* and end covers 52 and 54 being joined to sections 16*b*. The end covers are joined to the panel sections 14*b* and 16*b*** by fold lines that are perpendicular to the fold lines separating the various equal side sections of the enclosures.

In summary, it can be seen that numerous advantages result from the practice of the invention. This infant support system is lightweight, approximately 2 lbs. 12 oz. for the Preferred embodiment, and can be used for a variety of purposes. It can be used to confine an infant lying on the floor, sitting on the floor or supported in a semi-erect position supported on the infant's chest and abdomen. Due to its compactable size and light weight, the system can be readily moved and transported.

Advantageously, the system is sized to fit with a typical infant crib, with the cushions 14, 16 having a length corresponding to the width of a typical infant mattress. Thus, the support system of the invention can be used in an infant crib leaving half of the crib available for other uses, such as diaper changing supplies and diaper storage. Additionally, this preferred sized allows for two of the infant support systems to be placed side-by-side in the same infant crib. Thus, a single infant crib can be used for two infants The foregoing description of the preferred embodiment of the invention has been presented for Purposes of illustration and description. It is not intended to be exhaustive or to limit the invention to the precise form disclosed, and many modifications and variations are possible in light of the above teaching. The embodiment was chosen and described in order to best explain the principles of the invention and its practical application to thereby enable others skilled in the art to best utilize the invention in various embodiments and with the various modifications as are suited to the particular use contemplated. It is intended that the scope of the invention be defined by the claims appended hereto.

What is claimed is:

1. A multipositional infant support system for supporting an infant in a variety of positions, comprising:

(a) a substantially rectangular panel of sheet material, said panel being sufficiently flexible so as to be freely foldable along a plurality of arbitrarily chosen parallel or non-parallel fold lines;

(b) first and second resilient longitudinal cushions having ends said first and second cushions being releasably secured respectively to two opposite sides of the panel, said cushions being in spaced parallel relationship so as to provide a centrally disposed confinement area on the panel for confining an infant between the cushions whenever the confinement area of the panel is in a flattened, non-folded condition, the cushions being movable to different relative positions when the panel is folded; and (c) separable fastener means located on the ends of said cushions to permit the releasable interlocking and joining the cushions at their respective ends so as to provide an infant back support at the joined ends of the cushions when the panel is folded and the cushions are placed in a V-shaped configuration.

2. A multipositional infant support system as recited in claim 1 wherein the first and second longitudinal cushions are retained by first and second enclosures formed by overlapping the opposite sides of the panel inwardly toward the confinement area.

3. A multipositional infant support system as recited in claim 2 further including a plurality of hook and loop fasteners for releasably securing the opposite sides of the panel in their respective inwardly overlapped positions.

4. A multipositional infant support system as recited in claim 3 wherein each of the hook and looP fasteners include a first strip component on the edge of the panel side and a second cooperating strip component positioned inwardly on the panel at the edge of the confinement area, said second strip component being in spaced parallel relationship to its respective first strip component.

5. A multipositional infant support system as recited in claim 2 further including a plurality of straps secured to the panel for releasably securing an infant in a variety of positions relative to the longitudinal cushions.

6. A multipositional infant support system as recited in claim 2 wherein the longitudinal cushion are formed of foam material.

7. A multipositional infant support system as recited in claim 6 wherein the panel is foldable so as to position the longitudinal cushion enclosures in a contacting longitudinally juxtaposed relationship so as to functionally form a single resilient support surface for an infant.

8. A multipositional infant support system as recited in claim 7 further including a strap secured to the central portion of the confinement area and extending beneath the confinement area in a direction parallel to the longitudinal direction of the cushions.

9. A multipositional infant support system as recited in claim 8 further including a pair of cooperating straps secured to longitudinal cushion member closures for securing an infant in a sitting position adjacent the joined ends of the cushions when the cushions are in a V-shape configuration.

10. A multipositional infant support system as recited in claim 2 wherein each of the cushions is formed of foam material and has a generally square cross-sectional configuration and each of the cushion enclosures are formed by four sections of substantially equal areas separated by substantially parallel fold lines.

11. A multipositional infant support system as recited in claim 10 wherein a hook and loop fastener is secured to the third most outer section of each end for releasably securing the cushion enclosures in contacting longitudinally juxtaposed relationship.

12. A multipositional infant support system as recited in claim 11 further including end covers joined to each longitudinal end of the second most outer section from each side, the end covers being joined to the second most outer sections by a fold line substantially perpendicular to the fold lines separating the four sections.

13. A multipositional infant support system as recited in claim 11 further including a resilient pad removably positioned in the confinement area between the longitudinal cushions.

14. A multipositional infant support system as recited in claim 10 further including cooperating hook and loop fasteners for releasably securing each of the opposite sides of the panel in their respective inwardly overlap positions, said hook and loop fasteners including strips at the edges of the panel sides with cooperating strips at the inward edge of the fourth inner most sections on the top of the panel adjacent the confinement area.

15. A multipositional infant support system as recited in claim 10 further including a strap secured to the central portion of the confinement area and extending beneath the confinement area in a direction parallel to the longitudinal direction of the cushions.

16. A multipositional infant support system as recited in claim 10 further including a pair of cooperating straps secured to the longitudinal cushion enclosures for securing an infant in a sitting position adjacent the joined ends of the cushions when the cushions are in a V-shape configuration.

* * * * *